United States Patent [19]

Shiraishi et al.

[11] Patent Number: 4,812,837

[45] Date of Patent: Mar. 14, 1989

[54] LC DISPLAY DEVICE WITH BOTH POSITIVE AND NEGATIVE IMAGE DISPLAY MODES

[75] Inventors: Tomikatsu Shiraishi, Nara; Mitsuru Fujiwara, Yamatokoriyama, both of Japan

[73] Assignee: Sharp Kabushiki Kaisha, Osaka, Japan

[21] Appl. No.: 205,524

[22] Filed: Jun. 13, 1988

Related U.S. Application Data

[63] Continuation of Ser. No. 884,509, Jul. 11, 1986, abandoned.

[30] Foreign Application Priority Data

Jul. 12, 1985 [JP] Japan ..... 60-154967

[51] Int. Cl.[4] ..... G09G 3/36

[52] U.S. Cl. ..... 340/784; 340/765; 340/791

[58] Field of Search ..... 340/752, 763, 765, 783, 340/784, 791, 723; 350/331 R, 332, 333

[56] References Cited

U.S. PATENT DOCUMENTS

| | | | |
|---|---|---|---|
| 3,967,881 | 7/1976 | Moriyama et al. | 350/335 |
| 4,212,011 | 7/1980 | Waldron | 340/784 |
| 4,241,339 | 12/1980 | Ushigama | 340/784 |
| 4,359,729 | 11/1982 | Nonomura et al. | 340/765 |
| 4,470,042 | 9/1984 | Barnich et al. | 340/723 |
| 4,518,959 | 5/1985 | Ueda et al. | 340/784 |
| 4,581,612 | 4/1986 | Jones | 340/752 |

*Primary Examiner*—John W. Caldwell, Sr.
*Assistant Examiner*—Jeffery A. Brier
*Attorney, Agent, or Firm*—Birch, Stewart, Kolasch, & Birch

[57] ABSTRACT

A liquid crystal display device includes a video RAM for storing character and graphic data, a control circuit for selecting specific data from the RAM to be displayed on a liquid crystal display panel, and a positive/-negative mode selector for selecting one of a positive display mode in which data is displayed as lighted elements against a dark background, and a negative display mode in which data is displayed as dark elements against a lighted background. The display device allows the use of software developed for CRT based data processors to be run in LCD mounted data processors in which the data formats would otherwise be reversed.

3 Claims, 4 Drawing Sheets

FIG. 3

PC-7000 SYSTEM SET-UP MENU (Version: X.XX DD/MM/YY)

------ Clock ------

Time: 10:19:35

Date: THU 06, JUN 1985

------ Display -----

| | |
|---|---|
| Cursor Blink: | 2/second |
| Cursor Type: | Underline |
| Character Blink: | 1/second |
| ▷ Display Background: | Standard |
| Display Mode: | Graphics |
| Backlight: | Standard |
| Backlight Timeout: | 5 minutes |

Ⓐ

--Internal SIO--

| | |
|---|---|
| Baud Rate: | 1200 |
| Date Bits: | 8 |
| Stop Bits: | 1 |
| Purity: | None |

-Internal Modem-

| | |
|---|---|
| Baud Rate: | 1200 |
| Data Bits: | 8 |
| Stop Bits: | 1 |
| Parity: | None |
| DTR/CD: | Override |
| Auto Answer: | No |

-- Logical Device --

COM1: Internal SIO

COM2: Internal Modem

----Printer -----

| | |
|---|---|
| Interface: | CE-700P |
| Font: | Courier |
| Mode: | VNLQ/Draft |

--- Miscellaneous ---

| | |
|---|---|
| Speaker Volume: | Medium |
| Processor Speed: | Standard |
| Default: | Ctrl-Space |

1. Position Cursor using cursor Keypad

2. Press Spacebar to change

3. Press Set-Up Key to exit

Display Background: Inverse (Negative Picture)

LC DISPLAY DEVICE WITH BOTH POSITIVE AND NEGATIVE IMAGE DISPLAY MODES

This application is a continuation of application Ser. No. 884,509, filed on July 11, 1986, now abandoned.

BACKGROUND OF THE INVENTION

The present invention relates to a display device or more specifically to a display device capable of selecting a positive or negative picture display mode.

On a CRT display, in general, the dots corresponding to display data emit light to make the data visible. On a liquid crystal display (LCD), in contrast, reflected light or background light of the elements corresponding to display data is blocked to display the data. Accordingly, the picture on a CRT display and that on a LCD are reversed from each other in terms of shade and light.

If software prepared by a CRT display-mounted data processor is run in a LCD-mounted data processor, therefore, data will be displayed as a negative picture.

From the standpoint of visual clarity, a positive picture may be more suitable for some data and a negative picture for other data.

For instance, the LCD is more suitable for showing graph and character data whereas the CRT display is more suitable for showing graphic data such as figures, objects and landscapes because it is possible to shade the picture by turning dots on and off.

SUMMARY OF THE INVENTION

The object of the present invention is to provide a display device that can selectively present data in a negative or positive picture mode depending upon the type of display data, making the best use of the advantages of each picture mode.

Other objects and further scope of applicability of the present invention will be apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

To achieve the above object, according to an embodiment of the present invention, a display device comprises means for selecting a negative or positive picture mode.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 3 shows an example of data presented on the display device of FIG. 1.

DETAILED DESCRIPTION OF THE INVENTION

The present invention will now be described with reference to the drawings. Here, a negative picture display refers to a display mode in which reflected light or background light of the elements corresponding to the display data is blocked to form the data, and a positive picture display refers to a display mode in which the dots corresponding to the display data emit light to form the data.

Figure 1:
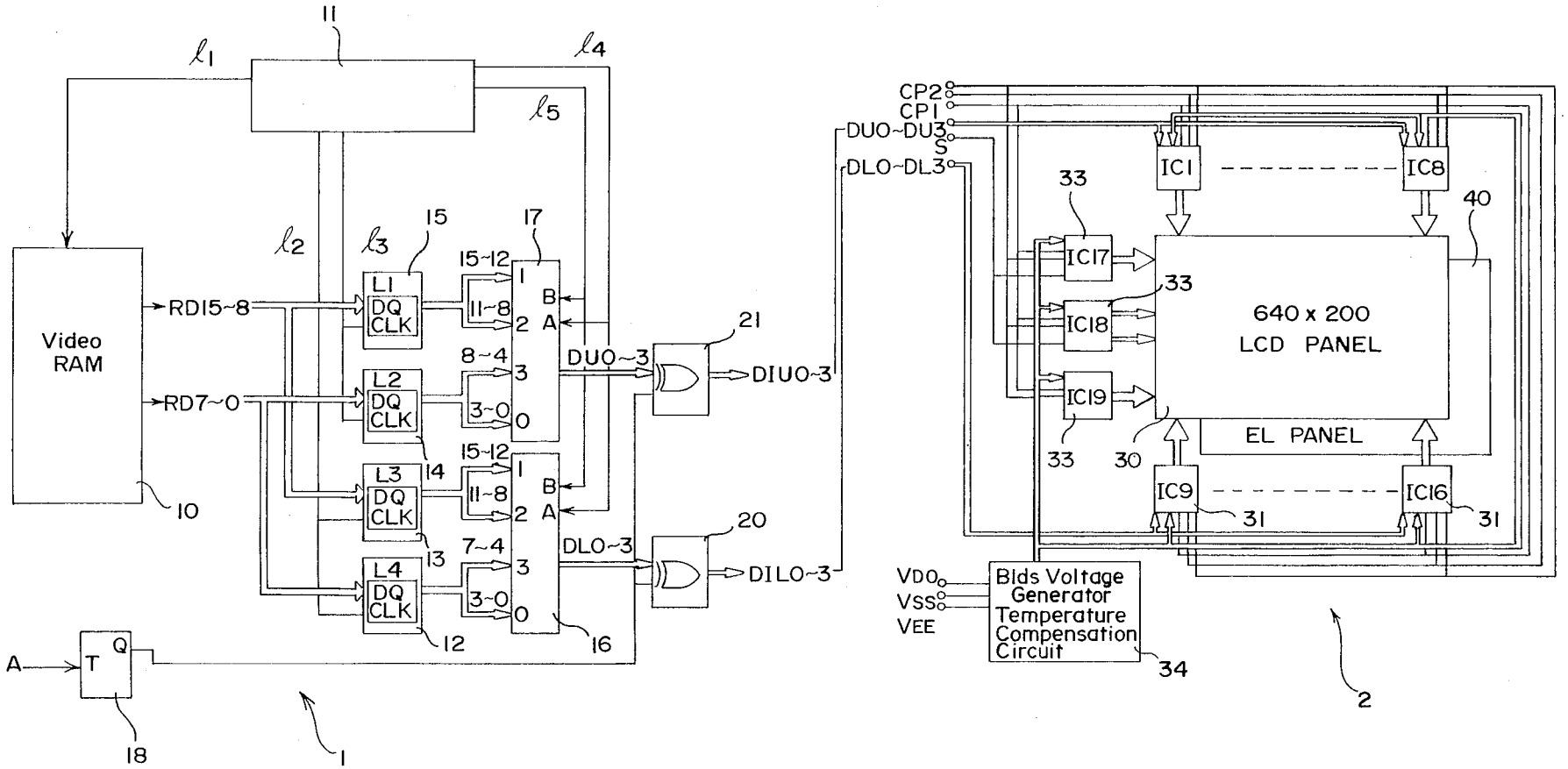
FIG. 1 is a block diagram showing the construction of an embodiment of the display device of the present invention.

FIG. 1 is a block diagram showing the construction of an embodiment of the display device of the present invention.

In this figure, 1 is a display data read processor and 2 is a liquid crystal display processor to which the display data is output.

The data read processor 1 is first described in detail.

A video memory (Video RAM) 10, which has a memory area for each display dot, reads display data when it receives $l_1$ signal from a read control circuit 11 operating synchronously with CP1 and CP2, the LCD drive timing signals. The video memory is divided into upper and lower blocks which are alternately accessed to read data by units of 16 bits.

With signals $l_2$ and $l_3$ from the read control circuit 11, the display data read out are temporarily retained in latch circuits 12, 13, 14 and 15. The latch circuits 12, 13, 14 and 15 have 8-bit memory capacity each and alternately hold data with the signals $l_2$ and $l_3$. Outputs from the latch circuits are sent to multiplexers 16 and 17 and output therefrom by units of 4 bits, being selected by signals $l_4$ and $l_5$ from the control circuit 11.

Each of the latch circuits 12, 13, 14 and 15 and the multiplexers 16 and 17 are divided into upper and lower blocks, so that 4 bit data are output simultaneously from each block of the multiplexers to a LCD panel which is also divided into upper and lower blocks.

The output from the multiplexers 16 and 17 is transmitted through Exclusive-OR circuits 21 and 20 to a liquid crystal drive circuit.

In addition to the display data, the Exclusive-OR circuits 21 and 20 receive the "set" signal from a T-type flip flop F/F 18 which is set or reset by a positive/negative picture selection signal A. When the flip flop 18 is reset, the display data is supplied directly as it is in a logic state to the liquid crystal drive circuit. When the flip flop 18 is set, on the other hand, the display data is output in an inverse logic state so that it is displayed in the form of the same positive picture as that on a CRT display.

Next, the LCD processor 2 is described in detail.

A liquid crystal panel 30 includes, for example, 640×200 dots and is provided with an EL (electroluminescence) panel at the rear as a background light. The liquid crystal panel 30 is divided into upper and lower blocks. The panel 30 has segment drive circuits 32 for applying data to the dot segments in the upper block of the panel, segment drive circuits 31 for the lower block of the panel, and common electrode drive circuits 33 for applying to common electrodes the voltage output from a bias voltage generator 34 which generates a specified voltage. According to the output from the Exclusive-OR circuits 21 and 20, data is displayed by the corresponding dot segments.

More specifically, with the output "1" from the Exclusive-OR circuits 21 and 20, background light is blocked so that data is displayed by dots on the LCD.

With the output "0" from the Exclusive-OR circuits 21 and 20, data is formed from background light transmitted so that shade and light of the CRT picture are reversed.

Thus, a positive picture or a negative picture can be selected by setting or resetting the flip flop 18.

Figure 2:
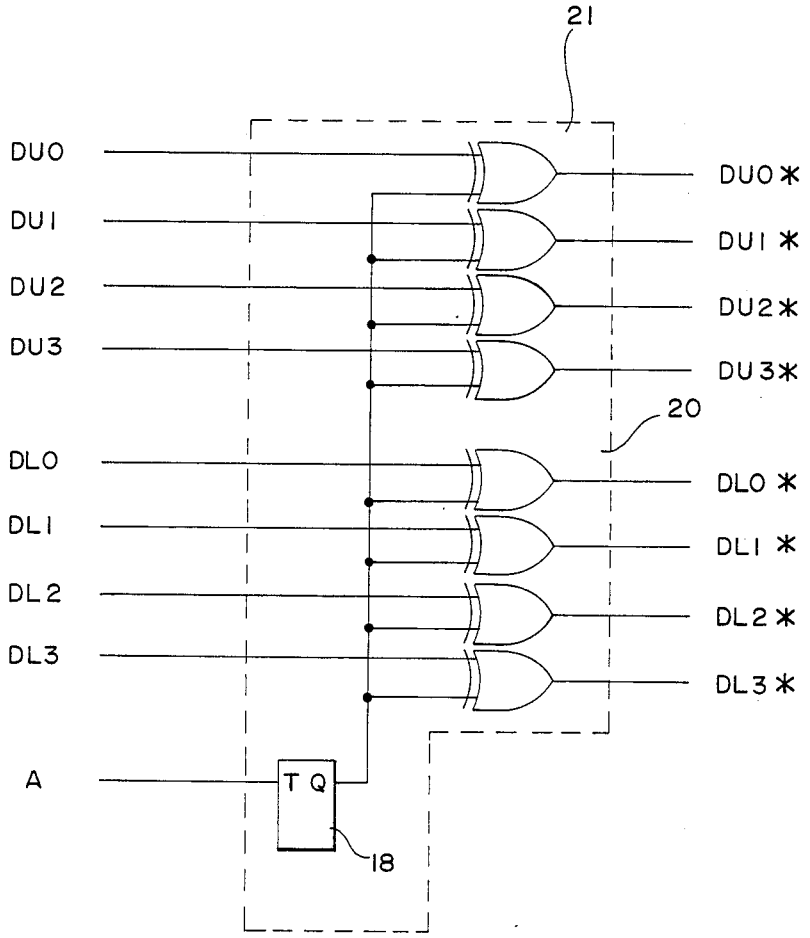
FIG. 2 is a partial gate circuit diagram of the display device of FIG. 1.

FIG. 2 shows the gate construction of the Exclusive-OR circuits. Data DU0* ~ DU3* and DL0* ~ DL3* are sent, through the positive/negative picture selection circuit portion comprising the Exclusive-OR circuits 21 and 20, to the LCD processor 2 as display data.

Figure 4:
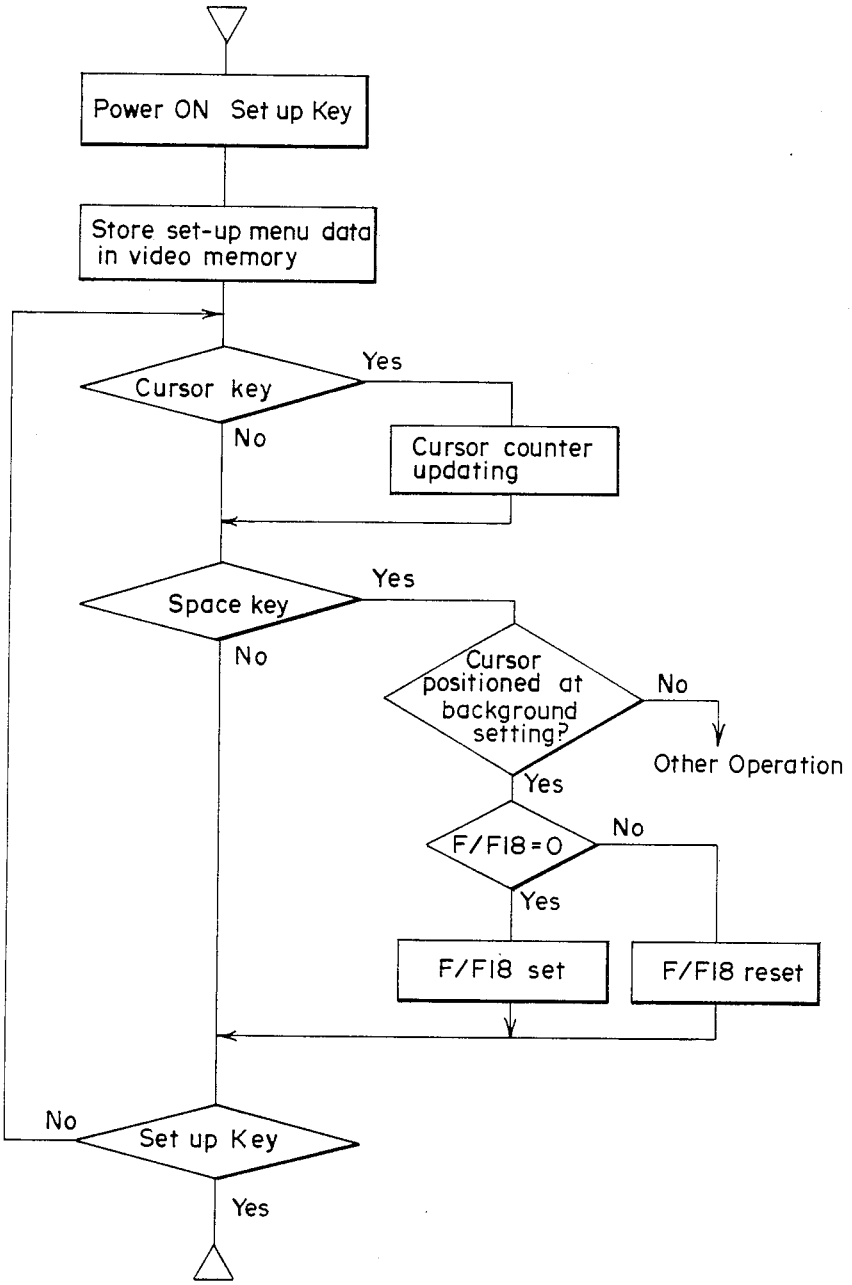
FIG. 4 is a processing flow chart of the display device of the present invention.

Now, generation of the positive/negative picture selection signal A is described with reference to FIG. 4.

When a POWER switch of the data processor is turned on or when the set up key on the keyboard (not shown) is depressed in a certain processing condition, the video memory 10 stores menu data for setting various modes according to an internal system program. As a result, data as shown in FIG. 3 is displayed on the LCD panel 30.

When the cursor key on the keyboard (not shown) is operated to position the cursor at (A) or, namely, at "Display Background" of the picture, the internal cursor counter is updated to be set at the value corresponding to the position (A).

When the space key is depressed on the keyboard at this stage, the flip flop 18 is set if it has been reset, or reset if it has been set. The positive or negative picture display mode is determined by the state (set or reset) of the flip flop 18.

When the flip flop 18 is reset, "Standard" is displayed at the position of "Display Background". When it is set, "Inverse" is displayed.

By depressing the setup key again, the display device is ready to display data according to the selected mode.

In the above embodiment, a positive/negative picture mode is selected by key operation on the keyboard. It is also possible to design the display device so that a character or graph command is generated by programming when character or graph data is to be displayed, or an image command is generated when image data is to be displayed on the LCD panel. These commands are needed when storing the respective data in the video memory. The flip flop 18 may be set/reset by the commands.

According to the present invention, as understood from the above, the display device is provided with means for selecting a negative or positive picture display mode, so that a desired display mode can be selected according to the type of display data and software of different display patterns can be run without any correction, which is very convenient.

While only certain embodiments of the present invention have been described, it will be apparent to those skilled in the art that various changes and modifications may be made therein without departing from the spirit and scope of the present invention as claimed.

What is claimed is:

1. A liquid crystal display device, comprising:

a liquid crystal display panel having a plurality of liquid crystal dot matrix display elements;

memory means for storing display data for each display element of said display panel;

control means for controlling the reading out of said data from said memory means as output display data signals;

positive/negative mode selector means for selecting one of a positive display mode in which data is displayed on said panel as lighted elements against a dark background, and a negative display mode in which data is displayed on said panel as dark elements against a lighted background;

read means responsive to said control means for reading said output display data signals from said memory means, including a plurality of latch circuits for storing said output data signals and a plurality of exclusive-OR gates having first input terminals coupled to receive said stored output data signals;

said positive/negative mode selector means including a flip-flop circuit for inputting a positive or negative mode signal to second input terminals of said exclusive-OR gates, said negative mode signal causing said exclusive-OR gates to invert the data signals at said first input terminals and output the inverted signals at output terminals, said positive mode signal allowing data signals at said first input terminals to be output on said output terminals; and driver means coupled to said output terminals for driving said display elements to display an image represented by said data signals.

2. The liquid crystal display device of claim 1, wherein said memory means comprises a video RAM.

3. The liquid crystal display device of claim 1, wherein said liquid crystal display panel is of the transparent type and includes a backlighting light source.

* * * * *